US005398871A

United States Patent [19]

Vescio

[11] Patent Number: 5,398,871

[45] Date of Patent: Mar. 21, 1995

[54] CONTAINER FOR BULK MATERIAL

[75] Inventor: James Vescio, San Antonio, Tex.

[73] Assignee: Union Camp Corporation, Princeton, N.J.

[21] Appl. No.: 223,656

[22] Filed: Apr. 6, 1994

[51] Int. Cl.[6] ..... B65D 5/74

[52] U.S. Cl. ..... 229/217; 229/117.24; 229/125.42; 229/137

[58] Field of Search ..... 229/117.24, 125.42, 229/137, 215, 216, 217, 219, 248, 249

[56] References Cited

U.S. PATENT DOCUMENTS

| | | | |
|---|---|---|---|
| 1,704,055 | 3/1929 | Morris | 229/219 |
| 2,107,096 | 2/1938 | Wesselman | 229/133 |
| 2,132,925 | 10/1938 | Bensel . | |
| 2,195,922 | 4/1940 | Gibson et al. . | |
| 2,300,703 | 11/1942 | Ray . | |
| 2,485,235 | 10/1949 | Grat | 229/133 |
| 2,830,505 | 4/1958 | Guyer | 229/133 |
| 3,003,673 | 10/1961 | Clark et al. | 229/217 |
| 3,059,826 | 10/1962 | Harms . | |
| 3,094,265 | 6/1963 | Hovland | 229/133 |
| 3,118,586 | 1/1964 | Kelly . | |
| 3,141,597 | 7/1964 | Palmer . | |
| 3,147,904 | 9/1964 | Larson . | |
| 3,172,594 | 3/1965 | Kuchenberger | 229/217 |
| 3,481,524 | 12/1969 | Ruud et al. . | |
| 3,743,164 | 7/1973 | Clark . | |
| 3,767,107 | 10/1973 | Forbes, Jr. | 229/248 |
| 3,892,347 | 7/1975 | Egleston . | |
| 4,166,566 | 9/1979 | Hamilton | 229/125.42 |
| 4,216,864 | 8/1980 | Austin, Jr. | 229/219 |
| 4,422,570 | 12/1983 | Lisiecki . | |
| 4,582,246 | 4/1986 | Lisiecki . | |
| 4,657,143 | 4/1987 | Forbes, Jr. | 229/217 |
| 4,913,292 | 4/1990 | Field . | |
| 5,086,928 | 2/1992 | Lisiecki . | |
| 5,106,015 | 4/1992 | Vlasaty et al. | 229/117.24 |
| 5,234,160 | 8/1993 | Lisiecki . | |
| 5,246,162 | 9/1993 | Heuberger et al. | 229/217 |

FOREIGN PATENT DOCUMENTS

| | | |
|---|---|---|
| 671135 | 9/1963 | Canada . |

*Primary Examiner*—Gary E. Elkins
*Attorney, Agent, or Firm*—Dennis H. Lambert

[57] ABSTRACT

A container for bulk material such as pet litter is defined by four walls and a bottom wall. The top of the container is provided with a carrying handle and a pour spout. During shipping and storage the pour spout is closed to prevent spillage of material from the container, but when it is desired to dispense material from the container the pour spout is unfolded to an open position. In a preferred embodiment the container is made from corrugated cardboard, and the pour spout is formed by perforated diagonal fold lines in an end flap and the adjacent side flaps. The size of the flaps and the placement of the fold lines confines the pour spout to one end of the top of the container, and the resultant pour spout has a generally triangularly shaped bottom wall and upstanding side walls, whereby accurate control can be maintained over pouring of the material from the container.

15 Claims, 3 Drawing Sheets

CONTAINER FOR BULK MATERIAL

TECHNICAL FIELD

This invention relates to a container for bulk packaging of flowable materials such as soap powder, flour, sugar, pet litter and the like. More particularly, but not by way of limitation, the invention relates to a shipping container for granular material such as pet litter or the like, wherein the container is provided with an easy to operate pour spout and a carrying handle.

BACKGROUND ART

Bulk materials such as pet litter and the like are commonly stored, shipped, and ultimately sold to the public in simple paper or cardboard containers, typically a bag or box, or plastic jugs. The bulk materials themselves are generally inexpensive, which makes any profit margin extremely small. Thus, any savings realized through less expensive shipping containers often becomes of extreme importance. In order to minimize cost, conventional containers do not ordinarily have a carrying handle or pour spout.

Bags, which are the most commonly used container for this purpose, are generally torn open at one end to form an opening through which the contents are poured. These bags are sometimes difficult to tear, and the resultant opening may be irregular, making it difficult to accurately control pouring of the contents from the bag. Further, the opening cannot be effectively resealed, and spillage is likely to occur if the bag should be tipped over.

Shipping containers without carrying handles and pour spouts create problems in carrying the container and transferring the bulk material to another receptacle when the material and container are finally sold to a consumer. Specifically, with no handle, the container may be awkward to carry and difficult to control when the stored bulk material is poured from it. Furthermore, there is little or no control over the direction and amount of bulk material poured from the shipping container if it has no pour spout. Thus, more often than not, an excessive amount of the bulk material is poured, resulting in a mess which must then be cleaned up. Essentially, the shipping of bulk materials in containers without carrying handles and pour spouts makes the transport of the container difficult, while the ultimate dispensing of the bulk material is troublesome and prone to spillage of the bulk material.

Accordingly, there is need for a shipping container that is inexpensive, and yet which provides a carrying handle and pour spout for the easy carrying and dispensing of a bulk material shipped in the container.

DISCLOSURE OF THE INVENTION

The present invention comprises an inexpensive, recyclable container for bulk packaging of flowable materials such as soap powder, flour, sugar, pet litter and the like, wherein the container is provided with an easy to operate pour spout and a carrying handle.

More specifically, the invention comprises a box that is provided with a carrying handle and which has a top or lid portion, a part of which may be opened to form a pour spout that may be easily reclosed. During transportation and storage of the shipping container, the lid portion, including the part forming the pour spout, folds flat to seal the shipping container and facilitate stacking of the containers one on top of one the other.

When opened, the pour spout functions to allow easy regulation of the flow of bulk material from the container, as well as easy control over the direction of the flow of bulk material. Further, the pour spout is constructed so that it may be easily reclosed after bulk material has been dispensed from the container. The handle is provided to facilitate ease in carrying the container and to furnish a grip that provides better control of the container during pouring of the material from it.

The shipping container of the invention is rectangular in shape, having four side walls, a bottom wall and a top wall or lid. When sealed and ready for shipment, the lid is flat, thereby facilitating stacking and storage of a plurality of the containers, Moreover, the box is constructed in a way that eliminates leakage of small particles of the bulk material from the corners of the container during handling, shipment and storage.

In a particular construction, the container or box is formed from a single blank of corrugated cardboard with flaps formed along top and bottom edges to close the ends of the box when folded together. The flaps are all of the same length, except where the pour spout is formed. The flaps which define the pour spout are shorter than the other flaps, and define a foldable pour spout at one end of the top wall of the box. The fold lines about which the pour spout is folded are defined by perforated score lines to enable the panels defining the pour spout to easily break or fold in either direction.

In the preferred construction, slots extend inwardly from the top and bottom edges of the blank to define the flaps, and these slots terminate short of the fold lines about which the flaps are folded to "pinch" the corners of the box closed when it is fully assembled, thereby preventing leakage of material from the box.

Further, in the box of the invention, the carrying handle is positioned to one side of the center of the lid, opposite the side on which the pour spout is located, so that when the box is lifted by the handle it automatically tends to tilt toward the end on which the pour spout is located, thereby facilitating use of the handle not only in carrying the box but also in dispensing material from the box. It is to be understood, however, that the handle may be located in the center of the lid, or another location, as desired.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

BEST MODE OF CARRYING OUT THE INVENTION

Figure 1:
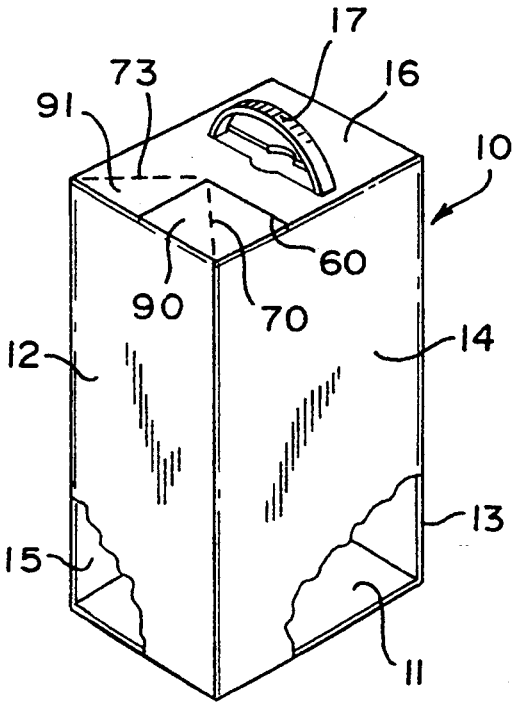
FIG. 1 is a top perspective view of the shipping container according to the invention, showing the container in its closed position.

Referring more particularly to the drawings, a container in accordance with a preferred form of the invention is indicated generally at 10 in FIGS. 1–6. In this form of the invention, the container comprises a rectangular box with a flat bottom wall 11, opposite end walls 12 and 13, a front wall 14, a back wall 15, and a lid or top wall 16.

A carrying handle 17 is secured to the top for carrying the box, and as depicted in full lines in FIGS. 1–5 is positioned to one side of the center of the lid. However, as shown in dot-and-dashed lines in FIG. 5, the handle could be located in another position, e.g., in approximately the center of the lid. Further, the handle is preferably flexible so that it flattens when two or more boxes are stacked on top of one another for storage or shipment.

Figure 2:
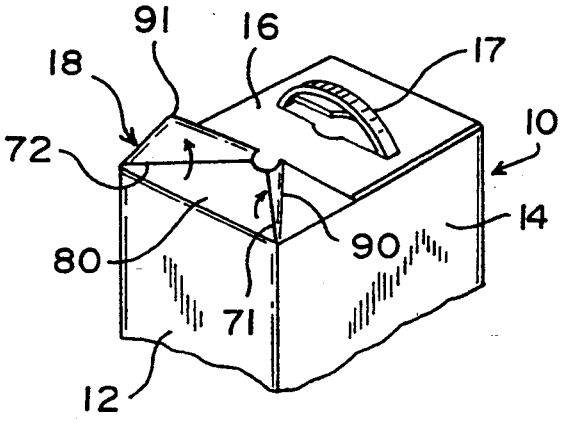
FIG. 2 is a fragmentary top perspective view of the container of the invention, showing the pour spout in a partially open position.
Figure 3:
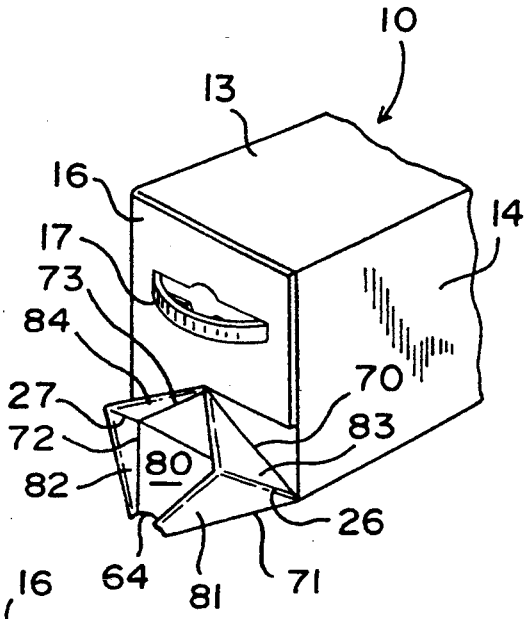
FIG. 3 is a fragmentary perspective view of the container of FIG. 1, with the container on its side and with the pour spout in fully opened position to dispense material from the container.
Figure 4:
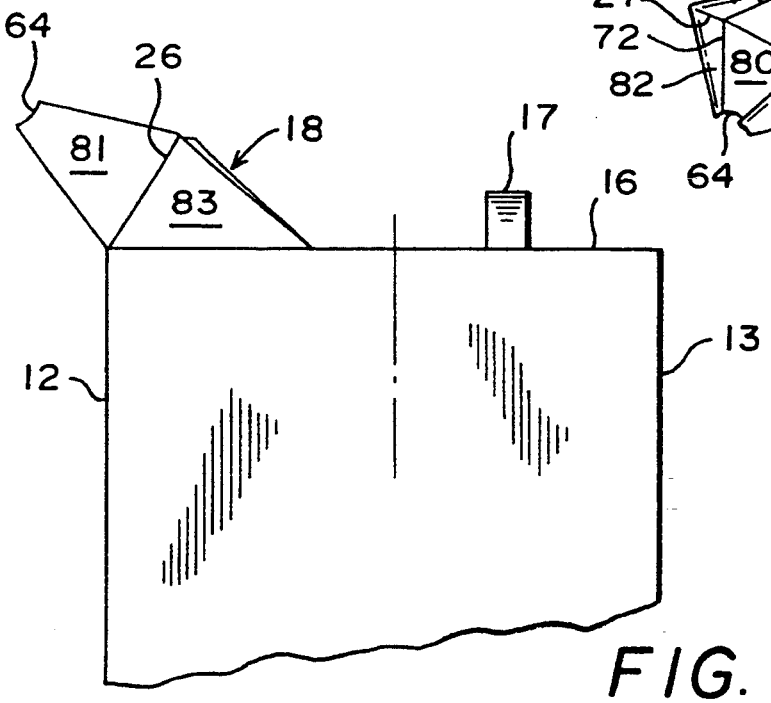
FIG. 4 is an enlarged, fragmentary side view in elevation of the container of FIG. 1, with the pour spout in its fully opened position.
Figure 5:
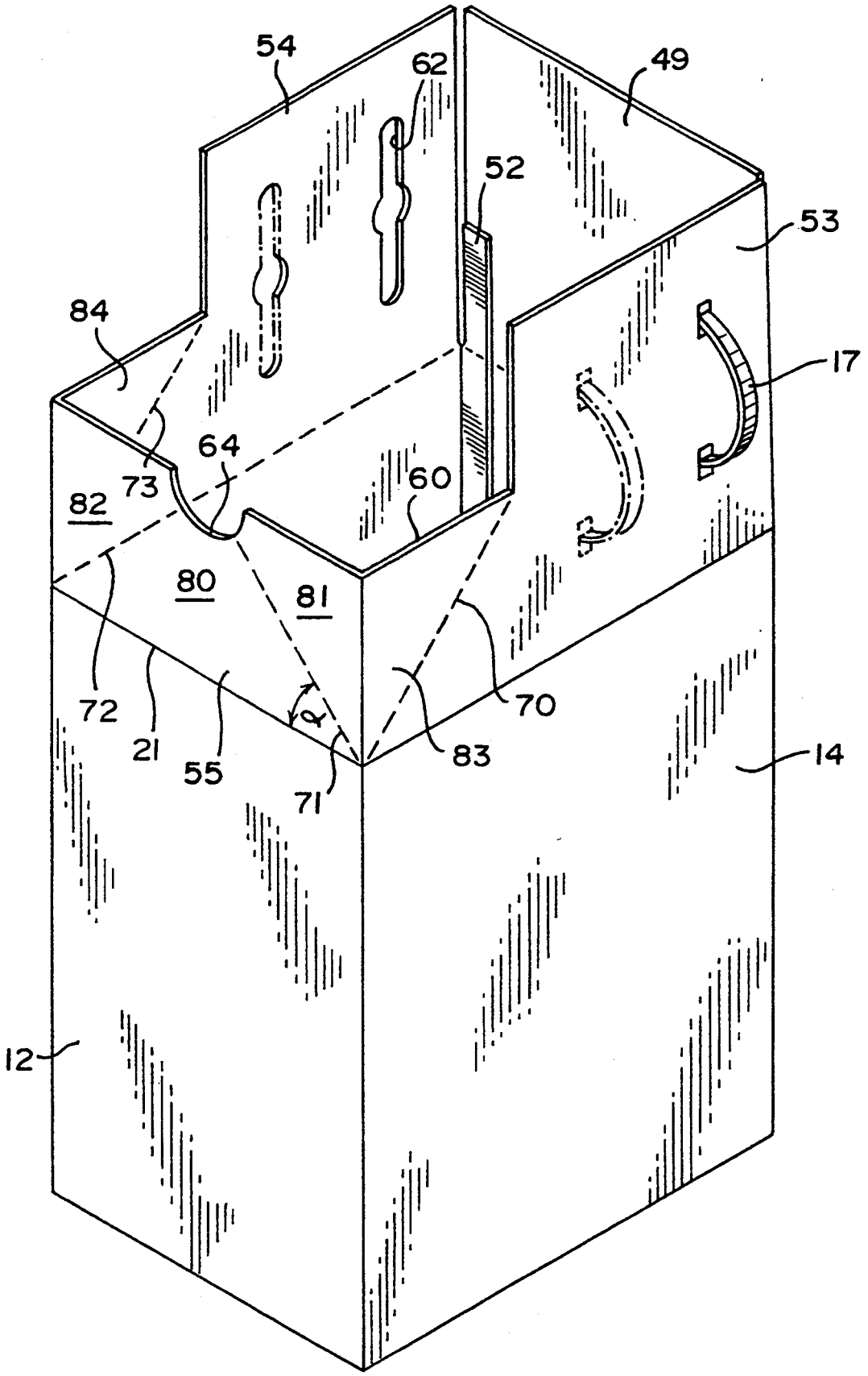
FIG. 5 is an enlarged top perspective view of the container of FIG. 1, showing the flaps and components that form the lid or top portion of the container in an unfolded condition, and showing the carrying handle located in alternate positions in dotted lines and in full lines, respectively.
Figure 6:
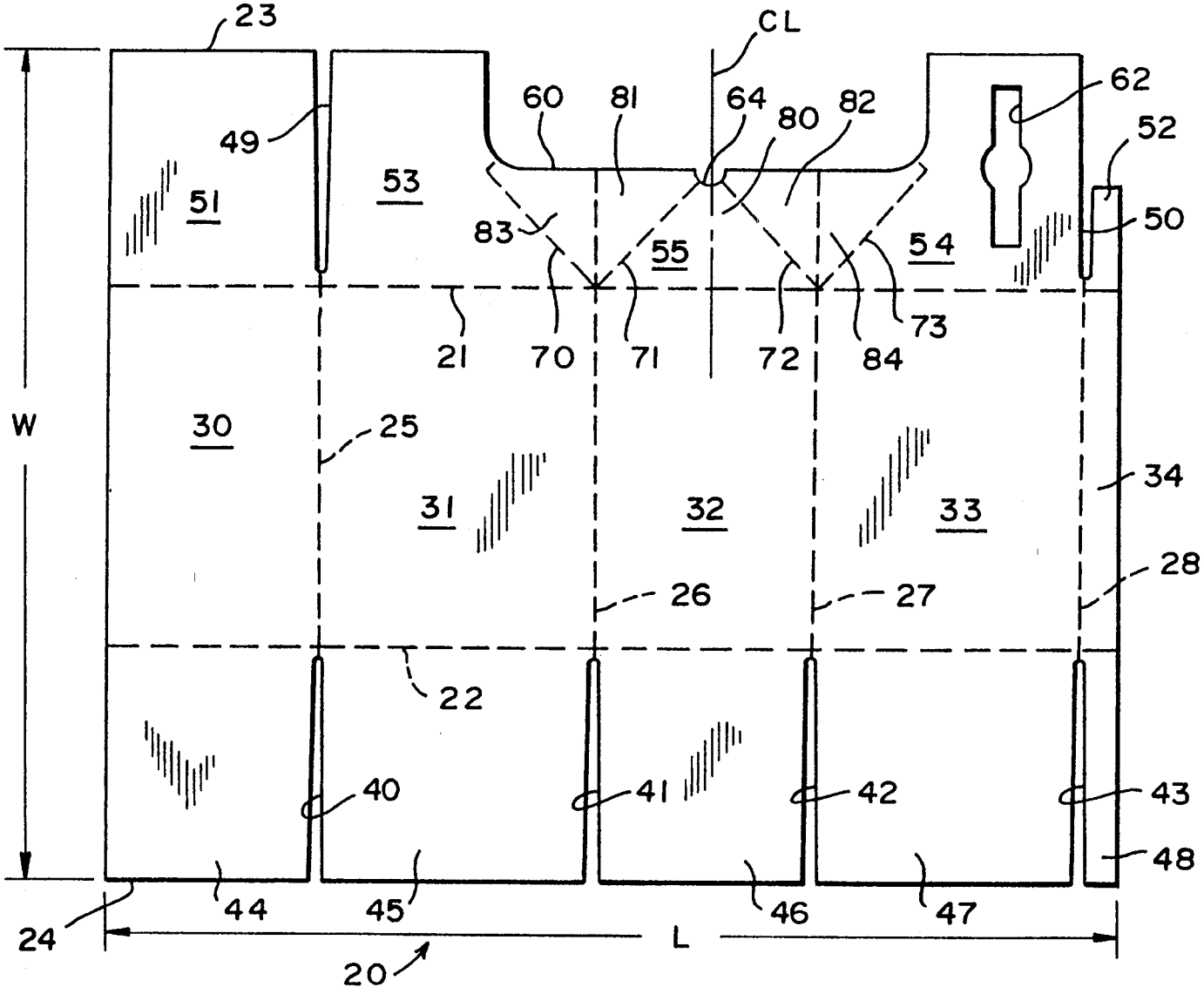
FIG. 6 is a top plan view of the blank that is used to make the container of FIG. 1.

A normally closed pouring spout 18 is also provided in the top, on the opposite side of the center of the lid from the handle 17, and when ready for use is unfolded as shown in FIGS. 2, 3 and 4 so that the contents of the box may be poured out. After dispensing a desired amount of material from the box, the pouring spout may be reclosed to the position shown in FIG. 1.

The box is preferably constructed from a single blank 20 of corrugated cardboard having a length L and a width W, with first and second parallel fold lines 21 and 22 creased into the material of the blank and extending along its length spaced inwardly from the top and bottom edges 23 and 24, respectively. Third, fourth, fifth and sixth parallel fold lines 25, 26, 27 and 28 are creased into the blank transversely across its width between the top and bottom edges. These transverse fold lines and the first and second fold lines 21 and 22 define first, second, third and fourth rectangular wall panels 30, 31, 32 and 33. In the completed box, panels 30 and 32 form the opposite end walls 12 and 13, and panels 31 and 33 form the front wall 14 and back wall 15, respectively. Further, the sixth transverse fold line 28 is spaced close to the end of the blank, defining a narrow flap or tab 34 at said one end.

A series of slots 40, 41, 42 and 43 extend inwardly from the bottom edge 24 of the blank in alignment with the transverse fold lines 25–28, and with the fold line 22 define first, second, third and fourth bottom wall flaps 44, 45, 46 and 47 on the bottom ends of the respective rectangular wall panels 30–33, each having the same width as the respective wall panel and each having a length to extend into overlapping relationship with the flap on an opposite wall when the box is assembled. The slot 43 also forms an end flap 48 on a bottom end of the tab 34 at said one end of the blank.

The top edge 23 of the blank is slotted at only two locations 49 and 50, aligned with the slots 40 and 43, respectively, in the bottom edge. Slot 49 defines with fold line 21 a top wall flap 51, and slot 50 defines with fold line 21 an end flap 52 on the top end of tab 34. The end flap 52 is truncated so that it extends only about one-half the distance from fold line 21 to the top edge 23 of the blank.

Additional top end flaps 53 and 54 are formed on the top ends of wall panels 31 and 33 by the slots 49 and 50 and the fold lines 21, 26 and 27, and a flap 55 is formed at the top end of wall panel 32 by fold lines 21, 26 and 27. Flaps 53, 54 and 55 are integrally joined to each other along the fold lines 26 and 27 at adjoining side edges of the flaps.

It will be noted that all of the slots 40–43, 49 and 50 terminate short of the respective fold lines 21 and 22, whereby when the panels and flaps are all folded into closed position to form an assembled box, the corners of the box are pinched closed, preventing leakage of material through the corners of the box.

A cut-out 60 is formed in the top edge of the blank, extending approximately one-half the distance from the top edge to the fold line 21 and outwardly from the centerline CL of panel 55 over flaps 53 and 54 slightly more than one-third their width.

A shaped opening 62 is also formed through flap 54, approximately centrally located in the area bounded by the top edge 23, fold line 21, slot 50 and adjacent end 63 of cut-out 60. As described hereinafter, this opening receives the carrying handle 17. Additionally, a shallow recess 64 is formed in the center of the free edge of flap 55 for a purpose to be described hereinafter.

The spout 18 is formed by making four diagonally extending perforated score lines 70, 71, 72 and 73 in the panels shortened by the cut-out 60, with two of the score lines 70 and 71 diverging outwardly from the intersection of fold lines 21 and 26, at a 45° angle with respect to fold line 21, and terminating at their outer ends adjacent the left hand inner corner of the cut-out and adjacent the recess 64, respectively. Similarly, the other two diagonal score lines diverge outwardly from the intersection of fold lines 21 and 27, at a 45° angle with respect to the fold line 21, and terminate at their outer ends adjacent the right hand inner corner of the cut-out 60 and the recess 64, respectively. The use of perforated score lines enables the corrugated cardboard material to be be easily folded in either direction about the score line.

The diagonal score lines 71 and 72, together with fold lines 21, 26 and 27, divide the flap 55 into a triangular center panel 80, with two triangular side panels 81 and 82 contiguous thereto on opposite sides thereof. The diagonal score lines 70 and 73, together with fold lines 26 and 27, define further triangular side panels 83 and 84 in the adjacent flaps 53 and 54, contiguous with panels 81 and 82 and forming mirror images thereof.

With the blank thus formed, it is folded to make the box of the invention as follows. Container end wall panel 30 is folded along fold line 25 until it is substantially pependicular to container front wall panel 31. Likewise, container end wall panel 32 is folded along fold line 26 until it is substantially perpendicular to container back wall panel 31. Container end wall panel 33 is then folded along fold line 27 until it is substantially perpendicular to container end wall panel 32 and parallel to container front or side wall panel 31. After the folding has been performed as described, tab 34 will abut the edge of container end wall panel 30. The tab 34 is folded along fold line 28 until it is substantially perpendicular to container back or side wall panel 33 and substantially parallel to container end wall panel 30. The tab is then connected to the inside edge of container end wall panel 30 using any suitable fastening means, such as glue. As a result, container walls 12–15 are connected together to define the rectangular box shown in FIG. 1.

Next, tab 48 is folded along fold line 22 into the opening created between container walls 12–15 until tab 48 is substantially perpendicular to container walls 12–15. Bottom flaps 44 and 46 are then folded along fold line 22 into the opening until they also are substantially perpendicular to container walls 12–15. Bottom flaps 45 and 47 are then folded along fold line 22 until they contact and overlie bottom flaps 44 and 46. Finally, bottom flaps 45 and 47 are secured to bottom flaps 44 and 46 using any suitable fastening means, such as glue, thereby forming the bottom wall 11 of the box shown in FIG. 1.

To form the lid portion or top wall 16 of the box, including the pour spout 18, top flap 51 is folded along fold line 21 into the opening defined at the top of the box by walls 12–15, until it is perpendicular to these walls. At this time, flap 52 is also folded into the opening until it is perpendicular to the walls 12–15.

Following the steps described above, the top flap 55 is folded into the opening along fold line 21 until it is perpendicular to containers walls 12–15. Concurrently, top flaps 53 and 54 must be folded over the opening, utilizing fold line 21. Because top flaps 53 and 54 are formed integrally with top flap 55 along fold lines 26 and 27, closing of the lid portion can only be accomplished by folding the flap along score lines 70–73. Specifically, as top flaps 53, 55 and 54 are simultaneously lowered, triangular side panel 81 folds upwardly about score line 71 and triangular side panel 82 folds upwardly about score line 72, while at the same time triangular panel 83 folds upwardly about score line 70 and triangular panel 84 folds upwardly about score line 73. This allows the mirror image triangular panels 81 and 83 to fold together about fold line 26, forming a triangular flap or corner 90, and allows mirror image triangular panels 82 and 84 to fold together about fold line 27, forming a triangular flap or corner 91. As the end flaps 53–55 continue to move downwardly over the open end of the box, the respective pairs of folded together triangular panels, or flaps 90 and 91, collapse over the adjacent halves of the triangular center panel 80. As top flap 55 reaches a point perpendicular to the container walls 12–15, top flap 53 is slipped underneath top flap 54 such that it resides directly over top flap 51 and triangular panels 81 and 82. At this point, triangular side panels 81 and 82 of flaps 90 and 91 are secured to triangular center panel 80 using any suitable means, such as glue.

Additionally, and if necessary, top flap 53 may be secured to top flap 51 using any suitable fastening means, such as glue. Top flap 54 is positioned directly over the top flap 53 such that handle 17 fits through opening 62. The top flap 54 is then secured to the top flap 53 using any suitable fastening means, such as glue, thereby forming the lid portion or top wall 16 in its closed condition. With this arrangement, the handle is glued to the inside of the lid, forming a stronger construction than if the handle were glued to the outside.

Referring to FIGS. 1–4, the opening of the lid portion to form the pour spout 18 will be described. First, the folded together triangular side portions or flaps 90 and 91 are grasped and lifted upwardly (FIG. 2), exposing the triangular center panel 80 and the recess 64 therein. By grasping the center panel at the recess 64 and pulling upwardly and forwardly, the triangular panels spread apart and the spout unfolds to the position shown in FIGS. 3 and 4, with the triangular side panels forming side walls for the spout and triangular center panel 80 forming the bottom.

In addition to forming a notch to facilitate grasping and lifting of the center panel 80, the notch also functions to help direct the bulk material from the container during pouring.

It will be noted that the handle 17 is located to the right of the center line of the box, as viewed in FIG. 4, so that when the pour spout is opened and the box is lifted with the handle, it naturally tilts toward the pour spout to ease the pouring action.

It should further be noted that the flaps 44–48, 51 and 53–55 are all of the same length. This enables the blank to be maintained in proper alignment during manufacture. Additionally, the blank is preferably die cut, making it easier to round the corners and strip out scrap material during the manufacturing process.

A specific example of a box manufactured in accordance with the invention has a height of about $11\frac{1}{4}$ inches, with end walls 12 and 13 having a width of about $7\frac{3}{8}$, and the front and back walls 14 and 15 having a width of about 9 inches. For a box having these dimensions, the slots 40–43, 49 and 50 all terminate short of the respective fold lines 21 and 22 by a distance of about $\frac{3}{8}$ of an inch. It should be understood, however, that the box could have other dimensions, i.e., it could have equal dimensions on all sides or it could have a long, narrow shape.

While a particular embodiment of the invention has been illustrated and described in detail herein, it should be understood that various changes and modifications may be made to the invention without departing from the spirit and intent of the invention as defined by the scope of the appended claims.

What is claimed is:

1. A container for bulk material, comprising:

a front wall, a back wall and opposite end walls joined along opposite longitudinal side edges to form a rectangular enclosure having an open upper end and an open lower end;

a planar bottom closing the lower end of the enclosure;

a planar lid closing the upper end of the enclosure, said lid comprising a front flap, a back flap and opposite end flaps each integrally joined along a fold line at one edge thereof to an end of a respective one of said enclosure walls and having an opposite free edge, said flaps being folded inwardly about said fold lines over the enclosure to close the open upper end of the enclosure;

said planar lid and planar bottom, respectively, forming corners with said front, back and opposite end walls;

a foldable pour spout in said lid which may be opened to pour material from the enclosure and closed to prevent loss of material from the enclosure, said pour spout being defined by a plurality of diagonal fold lines in one of said end flaps forming a first, triangularly shaped center panel and second and third triangularly shaped side panels on opposite sides of the center panel, said triangular side panels being contiguous to a respective one of said front and back flaps, and a diagonal fold line in each of said front and back flaps, defining fourth and fifth triangularly shaped panels in said front and back flaps, respectively, that are contiguous to and form mirror images with said second and third triangular panels, said one end flap being folded inwardly about the fold lines therein over the open upper end of the enclosure so that the second and third triangularly shaped panels overlie the first triangularly shaped panel therein, and the fourth and fifth triangularly shaped panels in the front and back flaps, respectively, overlie the second and third triangularly shaped panels in said one end flap, thereby defining triangularly shaped corners on the front and back flaps which may be grasped and lifted to expose said first triangularly shaped panel that may then be lifted and pulled forward, unfolding said triangularly shaped panels about their respective fold lines to form said pour spout, with said first triangular shaped panel defining the bottom of the pour spout and the second through fifth triangular shaped panels defining the sides of the spout; and said one end flap having a length between the fold line at said one edge and the opposite free edge that is less than the length of the front and back flaps, and each of said front and back flaps having a first portion contiguous to said one end flap that has a length the same as the length of said one end flap.

2. A container as claimed in claim 1, wherein:

the container is formed from a rectangular blank, and at least some of the flaps are defined by slots extended inwardly from an edge of the blank toward but terminating short of the fold line at said one edge of said at least some flaps, whereby the corners of the container are pinched when the blank is fold to form said container, preventing leakage of material from the container.

3. A container as claimed in claim 1, wherein:

the first portion of each of said front and back flaps extends over approximately one-third their width; and the diagonal fold lines in the front and back flaps extend diagonally across the first portions of the front and back flaps, whereby the pour spout is formed of flaps having a reduced length relative to the front and back flaps on the container and is at one end of the container lid.

4. A container as claimed in claim 3, wherein:

the container is formed from a rectangular blank, and at least some of the flaps are defined by slots extended inwardly from an edge of the blank toward but terminating short of the fold line at said one edge of said at least some flaps, whereby the corners of the container are pinched when the blank is folded to form said container, preventing leakage of material from the container.

5. A container as claimed in claim 4, wherein:

the container is made of corrugated cardboard; and the diagonal fold lines in said one end flap and the adjacent front and back flaps comprise perforated score lines, whereby the triangular panels formed thereby may be easily folded in either direction about said perforated score lines.

6. A container as claimed in claim 1, wherein:

a carrying handle is attached to the lid of the container to facilitate carrying of the container.

7. A container as claimed in claim 3, wherein:

a carrying handle is attached to the lid in a position intermediate the front and back walls but spaced farther from the end wall where the pour spout is formed than from the other end wall.

8. A container as claimed in claim 1, wherein:

a hole is formed through said front flap;

said front flap overlies said back flap in the assembled container; and a carrying handle is secured to the back flap, said carrying handle extending through the hole in the overlying front flap, thereby reinforcing attachment of the handle to the container.

9. A container as claimed in claim 7, wherein:

a hole is formed through said front flap;

said front flap overlies said back flap in the assembled container; and said carrying handle is secured to said back flap and extends through the hole in the overlying front flap, thereby reinforcing attachment of the handle to the container.

10. A container as claimed in claim 6, wherein:

the container is made of corrugated cardboard; and the diagonal fold lines in said one end flap and the adjacent front and back flaps comprise perforated score lines, whereby the triangular panels formed thereby may be easily folded in either direction about said perforated score lines.

11. A container as claimed in claim 1, wherein:

a hole is formed through said front flap;

said front flap overlies said back flap in the assembled container; and a carrying handle is secured to the back flap, said carrying handle extending through the hole in the overlying front flap, thereby reinforcing attachment of the handle to the container.

12. A container as claimed in claim 1, wherein:

the container is formed from a rectangular blank, and at least some of the flaps are defined by slots extended inwardly from an edge of the blank toward but terminating short of the fold line at said one edge of said at least some flaps, whereby the corners of the container are pinched when the blank is folded to form said container, preventing leakage of material from the container.

13. A container as claimed in claim 12, wherein:

the first portion of each of said front and back flaps extends over approximately one-third their width; and the diagonal fold lines in the front and back flaps extend diagonally across the first portions of the front and back flaps, whereby the pour spout is formed of flaps having a reduced length relative to the front and back flaps on the container and is at one end of the container lid.

14. A container as claimed in claim 13, wherein:

a carrying handle is attached to the lid in a position intermediate the front and back walls but spaced farther from the end wall where the pour spout is formed than from the other end wall.

15. A container having at least four walls defining an enclosure, a planar bottom closing and sealing a first end of said enclosure, and a planar lid closing and sealing a second end of said enclosure, said planar lid movable to an open position which creates a pour spout, and said pour spout comprising:

a first panel connected to a first one of said walls;

a second panel connected to a second one of said walls, said second panel having a first portion at one end of reduced height and provided with a diagonal fold line defining a triangular portion at said one end;

a third panel connected to a third one of said walls, said third panel having a first portion at one end of reduced height and provided with a diagonal fold line defining a triangular portion at said one end; and a fourth panel connected to a fourth one of said walls and to said one end of each of said second and third panels, said fourth panel having a height the same as the height of the first portion of the adjoining second and third panels and provided with first and second diagonal fold lines that divide said fourth panel into a first triangular portion that forms one side of said pour spout with said triangular portion of said second panel, a second triangular portion that forms a second side of said pour spout with said triangular portion of said third panel, and a third triangular portion that forms a bottom of said spout.

* * * * *